United States Patent [19]

Hazzard et al.

[11] 3,994,067

[45] Nov. 30, 1976

[54] APPARATUS FOR REMOVING ENTRAINED MATTER FROM THE INLET AIR OF A CHAIN SAW INTERNAL COMBUSTION ENGINE

[75] Inventors: Harry Irvin Hazzard, Culver City; Harold Edward Moore, Torrance, both of Calif.

[73] Assignee: McCulloch Corporation, Los Angeles, Calif.

[22] Filed: Jan. 10, 1975

[21] Appl. No.: 540,096

Related U.S. Application Data

[63] Continuation of Ser. No. 306,195, Nov. 14, 1972, abandoned.

[52] U.S. Cl. ..... 30/383; 30/381; 55/319; 55/337; 55/385 R; 55/400; 55/428; 83/788; 123/41.65; 123/41.7

[51] Int. Cl.[2] ..... B23D 57/02; B01D 45/14

[58] Field of Search ..... 55/407, 97, 406, DIG. 28, 55/473, 400, 319, 385, 437, 438, 471, 337, 428; 83/788; 123/41.63, 41.65, 41.7, 41.11, 41.17, 41.34; 30/381, 383

[56] References Cited

UNITED STATES PATENTS

| | | | |
|---|---|---|---|
| 1,784,067 | 12/1930 | Holston | 55/385 X |
| 1,941,449 | 1/1934 | Sylvan | 55/407 |
| 1,963,401 | 6/1934 | Clason | 55/407 X |
| 2,011,888 | 8/1935 | Bernard | 55/407 |
| 2,039,127 | 4/1936 | Sylvan | 55/406 X |
| 2,069,379 | 2/1937 | Moe | 55/DIG. 28 |
| 2,606,628 | 8/1952 | Hasselwander | 55/319 |
| 2,610,701 | 9/1952 | Goldberg et al. | 55/473 X |
| 2,692,086 | 10/1954 | Butler, Jr. | 123/41.1 X |
| 2,747,558 | 5/1956 | Kiekhaefer | 123/41.65 X |
| 2,825,318 | 3/1958 | Mansfield | 55/400 X |
| 3,183,899 | 5/1965 | Tuggle | 123/41.65 |
| 3,372,718 | 3/1968 | Irgens | 83/788 |
| 3,581,717 | 6/1971 | Fullerton | 123/41.65 X |
| 3,877,902 | 4/1975 | Eriksson et al. | 55/337 |
| 3,881,250 | 5/1975 | Frederickson | 55/DIG. 31 |

FOREIGN PATENTS OR APPLICATIONS

| | | | |
|---|---|---|---|
| 13,930 | 1/1915 | United Kingdom | 55/406 |
| 132,586 | 9/1919 | United Kingdom | 55/407 |

*Primary Examiner*—Bernard Nozick
*Assistant Examiner*—N. Greenblum
*Attorney, Agent, or Firm*—Burns, Doane, Swecker & Mathis

[57] ABSTRACT

A method and apparatus for removing entrained matter from the intake air of a chain saw internal combustion engine of the type including at least one piston and cylinder, a crank shaft, and a carburetor.

The apparatus includes a shroud surrounding at least one end of the crank shaft with an air inlet fashioned into the shroud at a position adjacent to said one end of the crank shaft and an air outlet fashioned into the shroud at a position remote from the air inlet. An air passage opens into the shroud adjacent the crank shaft for providing fluid communication between the interior of the shroud and the carburetor. The crank shaft is provided with a hub having on opposite faces thereof a first and second cascade of radial flow compressor blades to centrifugally impel air and entrained particulate matter away from the crankshaft. The compressor blades serve to remove at least a portion of the entrained matter from the combustion inlet air prior to the air entering the air passage for delivery to the carburetor.

A further apparatus aspect of the invention includes an accumulation chamber positioned within the air passage which provides a flow reversal of the combustion air. A filter diaphragm is positioned across the accumulation chamber to further removed very fine particulate matter from the intake air prior to delivery to the carburetor.

1 Claim, 7 Drawing Figures

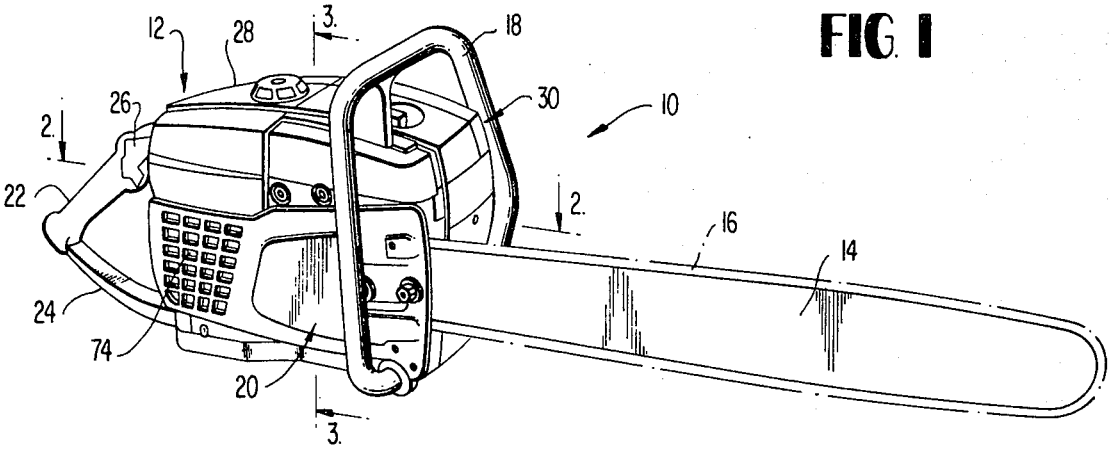
FIG. 1
FIG. 2
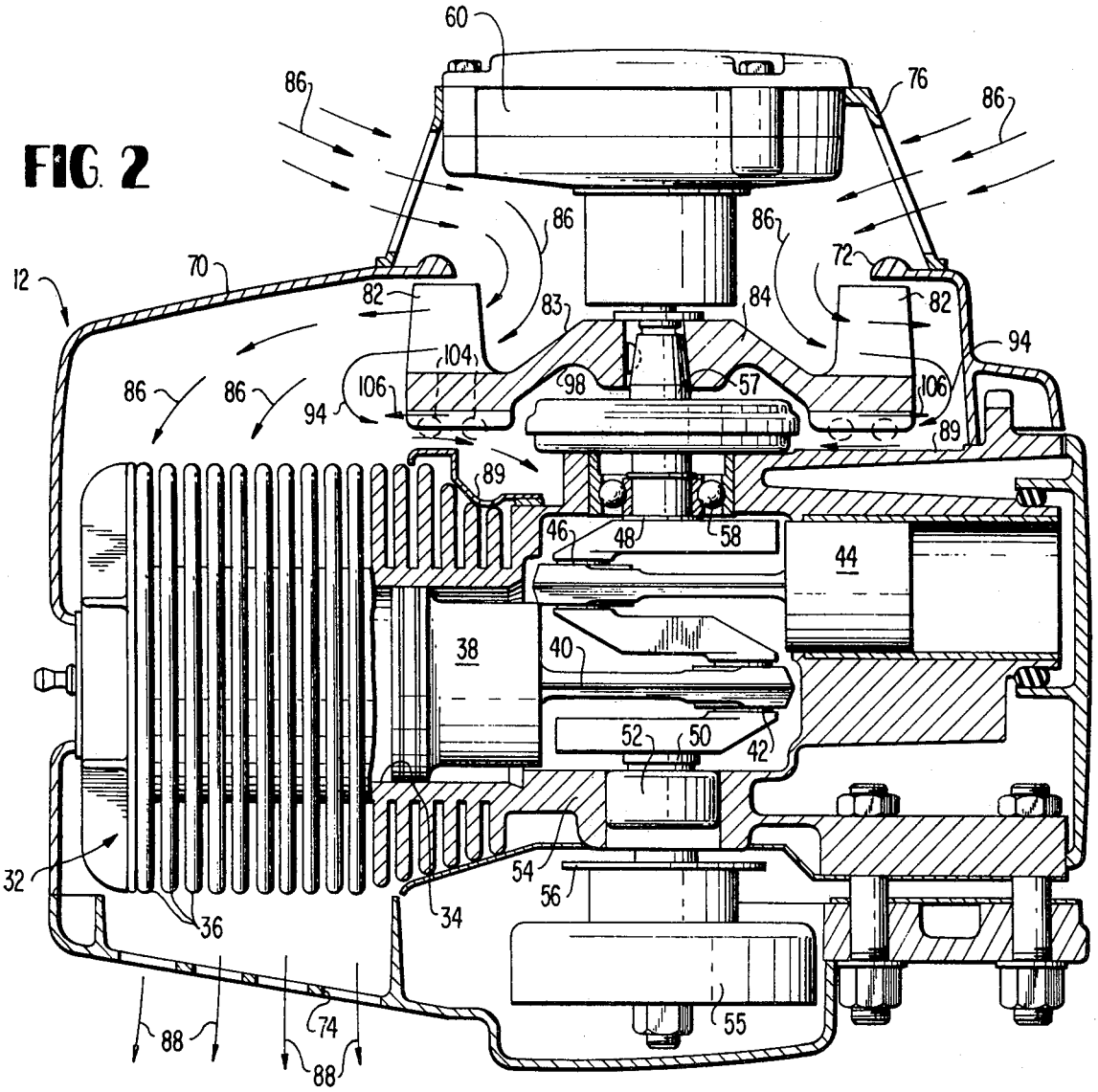

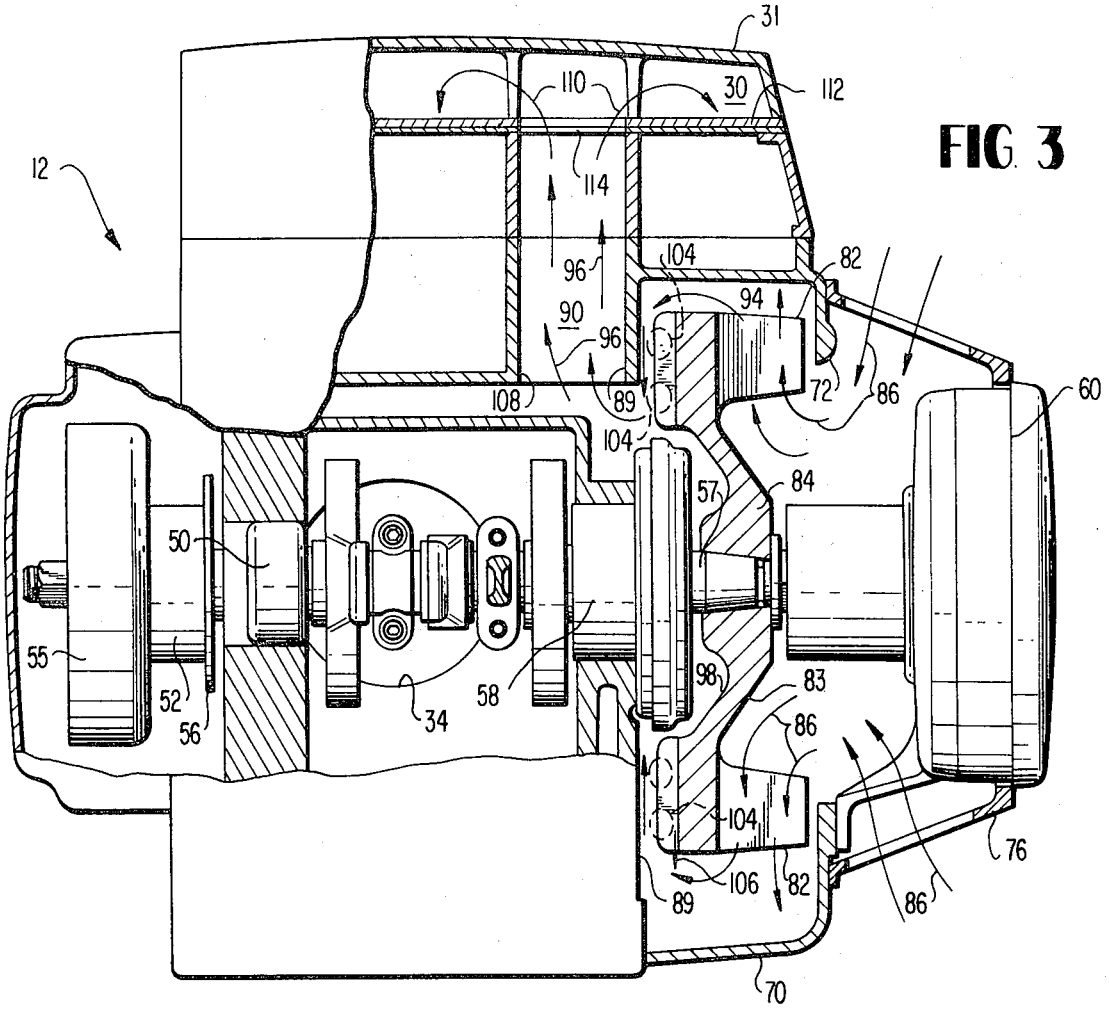
FIG. 3
FIG. 6
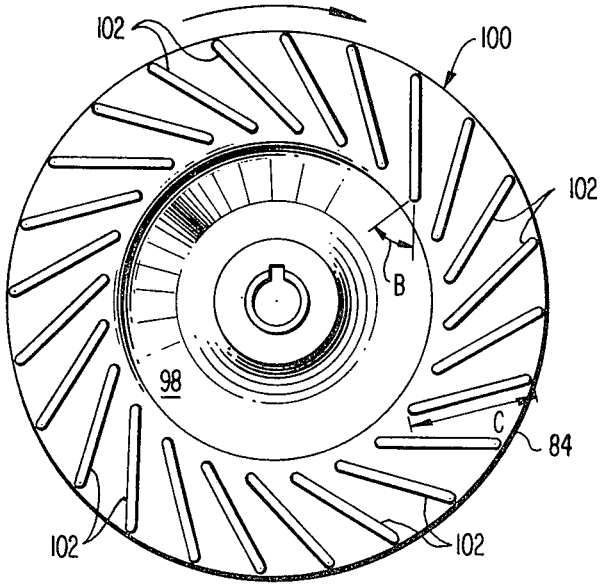
FIG. 5
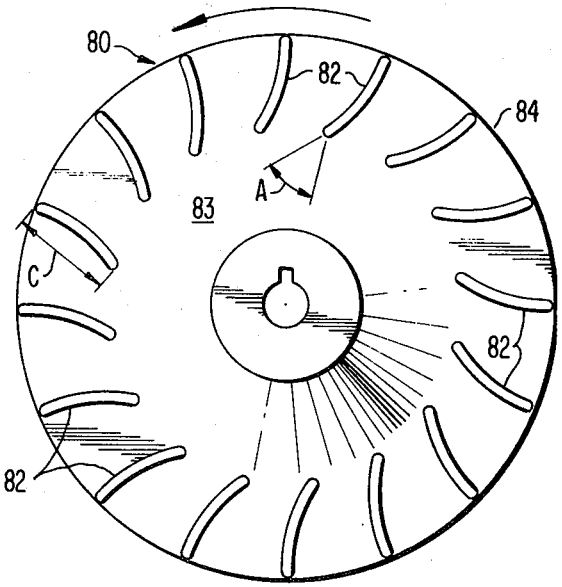

FIG. 4
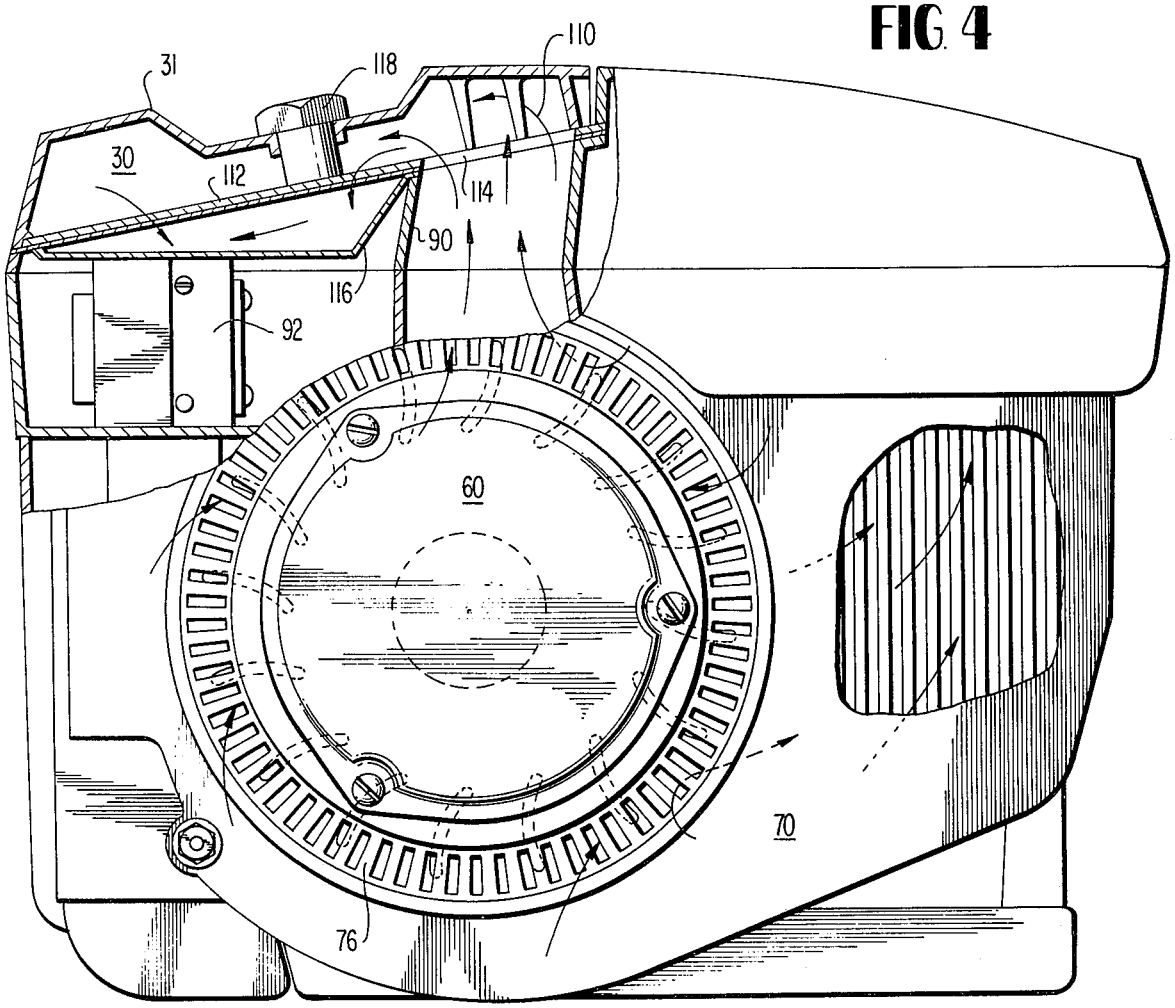
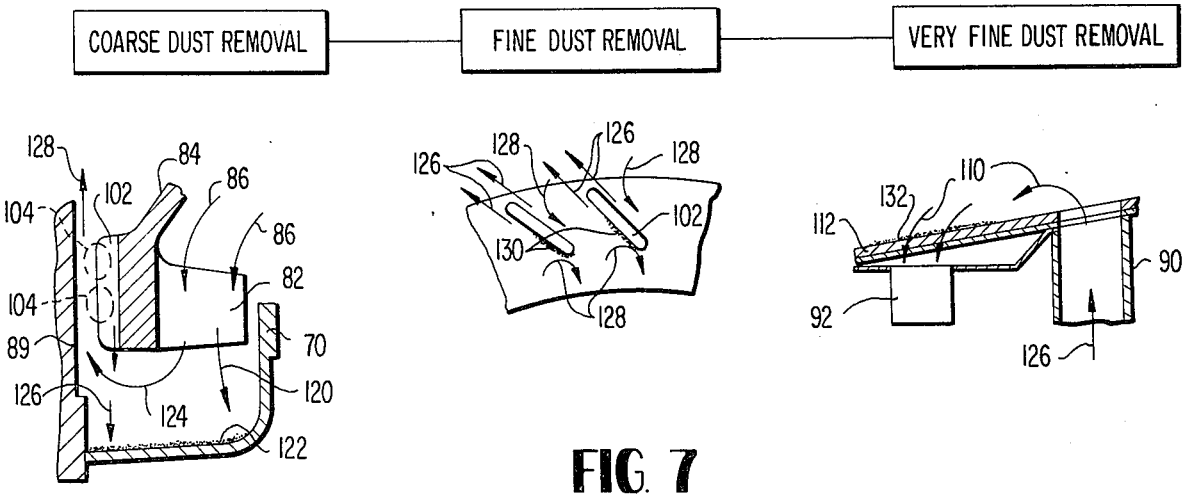
FIG. 7

APPARATUS FOR REMOVING ENTRAINED MATTER FROM THE INLET AIR OF A CHAIN SAW INTERNAL COMBUSTION ENGINE

This is a continuation, of application Ser. No. 306,195, filed Nov. 14, 1972 and now abandoned.

BACKGROUND OF THE INVENTION

This invention relates to a method and apparatus for removing particulate matter from the intake air of a chain saw internal combustion engine.

In the past portable chain saws have been extensively utilized. These devices generally comprise an internal combustion engine, a guide bar and an endless cutting chain carried by the guide bar and operatively connected to a crankshaft of the internal combustion engine. In order to facilitate portabiliy of these units the internal combustion engines are generally of the small one or two cylinder, two cycle, air cooled type.

The working environment for portable chain saws may range from logging camps to a homeowner's backyard. Almost universally, however, where portable chain saws possess a degree of utility, a common environmental denominator is the notable presence of dust, dirt and debris which is kicked up during a cutting operation. In this connection, air suspended debris or temporary atmospheric impurities may range from coarse matter such as relatively large sticks and leaves to very fine dust particles which may be as small as one micron in diameter. Since air suspended debris surrounds the operating saw it is highly subject to being sucked into the carburetor and the operating cycle of the internal combustion engine. Such foreign matter has long been known to possess deleterious effects both in terms of clogging accurately dimensioned carburetor and valve passages and also producing considerable abrasion wear within the interior of the combustion cylinders. Therefore, it would be highly desirable to eliminate or minimize the amount of particulate material that is drawn into the combustion cycle of a chain saw internal combustion engine along with the intake air.

In the past it has been common practice in the chain saw industry merely to utilize a conventional diaphragm or canister type filer for removing entrained matter from the inlet air. While such filters have exhibited a wide degree of utility room for improvement remains. More particularly previously known filter units by necessity have been produced with a considerable design compromise. On the one hand, if a coarse tortuous path filter is specified, fine particles easily pass through the filter and the engine is quickly damaged. If, however, a fine filter is specified large particles quickly clog the unit requiring frequent cleaning and/or replacement in order to maintain enough air flow into the carburetor to meet minium air/fuel mixture requirements. Moreover, if the chain saw is utilized in relatively cool climatic regions, moisture, held within a dust laden filter may freeze and block off air flow through the unit.

A refinement over the mere provision of a conventional inlet flter is disclosed in a U.S. Mansfield Pat. No. 2,825,318, issued Mar. 4, 1958. The Mansfield patent discloses an apparatus for supplying air to the carburetor of an internal combustion engine which utilizes, in combination with an intake screen, a rotary fan of the centrifugal type. The fan serves to impel air and entrained matter radially away from a crankshaft and out through a surrounding shroud. Intake air to the carburetor is drawn from within the shroud at a position behind a baffle positioned to separate the fan from an aperture in the shroud. By the provision of the above structure, a conventional air filter has been eliminated while dirt and dust within the inlet air is, at least to a degree, separated out of the air ultimately fed into the internal combustion engine. While the Mansfield apparatus is at least theoretically appealing room for significant improvement remains.

In this connection it will be noted that to the extent fine particulate matter remains entrained within the air that is drawn behind the baffle it will be directly pulled into the carburetor and the combustion cycle. Therefore, in many field applications where a large amount of fine dust and particulate matter is likely to be encountered it would be highly desirable to provide a method and apparatus for increasing the amount of foreign material that may be removed from the inlet air prior to the air entering the combustion system.

OBJECTS OF THE INVENTION

It is therefore a general object of the invention to provide a novel method and apparatus which will obviate or minimize problems of the type previously described.

It is a particular object of the invention to provide a novel method and apparatus for efficiently and effectively removing particulate matter entrained within the intake air of a chain saw internal combustion engine.

It is a further object of the invention to provide a novel method and apparatus to eliminate a conventional chain saw intake filter which quickly may become clogged and thus must be frequently serviced while maintaining and improving upon the debris removal function thereof.

It is yet a further object of the invention to provide a novel method and apparatus for removing entrained matter from the inlet air of a chain saw internal combustion engine which is suitable to remove a wide size range of particulate matter without requiring frequent servicing.

It is still a further object of the invention to provide a novel method and apparatus for removing entrained matter from the inlet air of a combustion engine utilizing a novel closed passage air delivery system wherein very fine particles of matter may be removed prior to the inlet air entering the internal combustion engine carburetor.

It is another object of the invention to provide a novel method and apparatus for removing entrained particulate material from the inlet air of a chain saw internal combustion engine which at least in part in self cleaning.

It is still another object of the invention to provide a novel method and apparatus for utilizing components which are synergistically compact and multifunctional to thereby maximize the removal of air entrained matter while minimizing the bulk and weight of a portable chain saw.

BRIEF SUMMARY.

An apparatus intended to accomplish at least some of the foregoing objects comprises a chain saw internal combustion engine wherein the engine includes at least one piston and cylinder, a crankshaft and a carburetor. A shroud surrounds at least one end of the crankshaft and includes an air inlet fashioned into the shroud adjacent one end of the crankshaft and an air outlet fashioned into the shroud remotely from the air inlet. A passage is connected into the shroud at a position adjacent to the one end of the crankshaft and is in fluid communication with the carburetor of the internal combustion engine.

A first centrifugal means is connected to the one end of the crankshaft, between the air inlet and the passage opening, for drawing air into the shroud and impelling the air and entrained particulate matter away from the crankshaft through the shroud and out of the air outlet. A second centrifugal means is also connected to the one end of the crankshaft, between the first centrifugal means and the passage, for centrifugally impelling air and entrained matter away from the crankshaft, through the shroud and out of the air outlet. By the provision of the first and second centrifugal means connected to the one end of the crankshaft air entrained particulate matter may be substantially removed before the inlet air enters the passage leading to the carburetor of the chain saw internal combustion engine.

A method aspect of the invention comprises drawing air into the shroud surrounding the one end of the crankshaft, centrifugally impelling the air and at least a portion of any entrained matter radially away from the crankshaft through the shroud and out of the air outlet, drawing air through the passage connected into the shroud adjacent the crankshaft and into the internal combustion engine carburetor and centrifugally impelling air and at least a further portion of any entrained matter away from the passage opening, so that matter entrained within the inlet air will be substantially removed prior to the inlet air entering the carburetor.

THE DRAWINGS

Other objects and advantages of the present invention will become readily apparent from the following detailed description of a preferred embodiment thereof taken in conjunction with the accompanying drawings, wherein:

FIG. 1 is a pictorial illustration of a chain saw, including an internal combustion engine having an air intake system comprising the subject matter of the instant invention;

FIG. 2 is a cross-sectional view taken along section line 2—2 in FIG. 1 and discloses, by directional arrows, the general flow pattern taken by inlet air as the air is drawn into a shroud surrounding the air cooled internal combustion engine of the chain saw;

FIG. 3 is a cross sectional view taken along section line 3—3 in FIG. 1 and further discloses, by the provision of directional arrows, the general flow path exhibited by air which is drawn into the shroud surrounding the chain saw internal combustion engine;

FIG. 4 is a side elevational view, partially broken away, which further discloses the intake air flow characteristics through the shroud of the portable chain saw including the flow of air into an accumulation chamber, through a diaphragm fiter and into the carburetor of the chain saw internal combustion engine;

FIG. 5 is a plan view of a first centrifugal means, including a hub and a cascade of radial flow compressor blades, which is positioned adjacent to the inlet of the shroud surrounding the internal combustion engine;

FIG. 6 is a plan view of a second centrifugal means comprising the opposite side of the hub disclosed in FIG. 5 and includes a cascade of radial flow compressor blades, which is positioned adjacent to the inlet of the air passage interconnecting the shroud and the carburetor; and FIG. 7 is a schematic representation of a succession of particulate material removal steps that are provided by the subject intake air handling system for a chain saw internal combustion engine.

DETAILED DESCRIPTION

General Structure.

Referring now to FIG. 1 there will be seen an illustration of a portable chain saw 10 including a portable power drive system 12, a guide bar 14 connected thereto, and an endless cutting chain 16 entrained around the guide bar. A centrifugal clutch system (not shown) is interposed between a crankshaft of the power drive 12 and a sprocket gear meshed with the cutting chain for providing selective R.P.M. controlled drive to the cutting chain.

The portable power drive 12 includes a frame and grip assembly 18 which is fixedly attached to a housing 20 of an air cooled internal combustion engine and operatively serves as one location for an operator to grasp and manipulate the chain saw. Remotely positioned with respect to the guide bar 14 is a control handle 22. The control handle is directly attached at the upper end thereof to a frame portion of the power drive assembly 12 and at the lower end thereof to a skid arm 24. An operator therefore may grasp the handle 22 and actuate a trigger throttle control 26 to provide controlled cutting actuation of the chain 16.

The upper portion of the portable power drive 12 is provided at a section rear thereof with a fuel tank 28 and at a fore section thereof with an accumulation chamber 30 to be described in detail hereinafter.

Referring now particularly to FIGS. 2 and 3, there will be seen cross-sectional views which disclose the internal construction of the portable power drive 12. In this connection, an air cooled internal combustion engine 32 is illustrated including a combustion cylinder 34 provided with a plurality of circmferentially disposed radially extending cooling vanes 36. A piston 38 is mounted for reciprocation within the cylinder in a conventional manner and is connected through a connecting arm 40 to a crank arm 42. In some instances in order to at least partially balance the operating cycle of the piston 38, a balancing piston 44 may be provided, which operates 180° out of phase with the power piston 38. The balancing piston 44 may be connected to a crank arm 46. A crankshaft 48 connects crank arms 42 and 46 and extends at one end 50 through a conventional ball bearing mounting 52 in the crank case 54 to a centrifugal clutch 55. As previously noted the centrifugal clutch operatively connects the crankshaft 48 within a cutting chain sprocket 56. The other end 57 of the crankshaft 48 extends through the opposite side of the crank case 54 via a conventional ball bearing mounting 58 to a position adjacent a hand operated recoil starter 60. The recoil starter serves in a conventional capacity to crank the engine during a starting operation.

Intake and Cooling Air Flow System.

Referring particularly to FIG. 2 there will be seen in cross-section an air shroud 70 which surrounds the one end 57 of the crankshaft adjacent to the starter 60. The shroud 70 extends around and surrounds the internal combustion engine cylinder 34. An air inlet opening 72 is fashioned into the shroud at a location adjacent to one end 57 of the crankshaft and an air outlet 74 is positioned remotely from the inlet 72 on an opposite side of the cylinder 34. By the provision of shroud 70 air may be directed over the cooling fins 36 of the cylinder in order to cool the cylinder. This cooling flow path is illustrated by direction flow arrows 86 and 88.

In order to prevent relatively large air entrained debris from entering the shroud 70 and thus clogging it, a frustoconical shaped slitted screen 76 is positioned between the shroud 70 and the casing of the starter 60, note FIG. 4.

The slitted screen 76 provides a first echelon in a system designed to remove particulate matter entrained within the inlet air of the internal combustion engine. In this connection, because of the very coarse nature of the slitted screen 76, only sticks, twigs, leaves, wood chips and the like are prevented from entering the shroud 70 by the provision of the screen 76. In order, however, to further remove particulate matter entrained within the inlet air, one end 57 of the crankshaft 48 is provided with a first cascade 80 or radial flow compressor blades 82. The blades 82 are mounted upon an outwardly extending surface 83 of a hub 84. Surface 83 as noted in FIG. 2 faces the air inlet opening 72.

The centrifugal compressor blades 82, as viewed in FIG. 5, are cambered in cross-section for smooth flow characteristics and also are provided with a nonradial leading edge angle -37 A" which increases the efficiency of the blade cascade.

The cascade 80 of radial flow compressor blades serves to draw inlet air through the coarse screen 76 into the shroud 70 in a manner depicted by flow arrows 86 in FIGS. 2 and 3. As previously discussed, a chain saw operational environment typically includes a significant amount of particulate matter entrained within the air, such as dirt particles and fine saw dust. This matter will readily pass through the coarse screen 76 and be sucked into the shroud 70 along with the intake air. The centrifugal vanes 82 serve to impart a high velocity to these particles in a direction radially away from the one end 57 of the crankshaft axis. Therefore, relatively large or coarse dust particles will pass through the shroud 70 and out the exit 74, along with cooling air as depicted by flow arrows 88 as seen in FIG. 2. The flow rate produced by the compressor blades 82 is sufficient to maintain any entrained particulate matter substantially in suspension thus minimizing any dust build-up within the shroud.

The shroud 70 is provided with an interior portion 89 which extends adjacent to the one end 57 of the crankshaft 48. A passage 90 is fashioned through the interior portion 89 of the shroud at a location adjacent to the one end 57 of the crankshaft. Passage 90 ultimately leads into a carburetor 92 which feeds into the internal combustion engine, note FIG. 4.

Air having a relative mass which is less than that of entrained dust particles will tend to be sucked around the outer edge of the hub 84, in a flow pattern as depicted by directional arrows 94, through the passage 90, as depicted by directional arrows 96, and utlimately into the carburetor 92. Very fine dust particles, however, having a lower radial momentum, attributable to the relatively smaller mass thereof as compared with larger coarse particles may also bend around the hub edge in a flow pattern similar to that depicted by arrows 94 and thus will tend to enter the passage 94 adjacent the crankshaft.

A third debris removal echelon, however, is provided to minimize the possibility of this finer particulate matter entering the carburetor. In this connection the back side 98 of the hub 84 is provided with a cascade 100 of radial flow compressor vanes 102. The compressor vanes 102, as best illustrated in FIG. 6, have a nonradial trailing edge angle B and are linear in cross section. Air and fine entrained impurities which tend to be sucked radially between the interior shroud portion 89 and the back side 98 of the hub 84 are slowed up and eddy currents depicted by circular phantom lines 104 may be formed, note FIGS. 2 and 3. Moreover, the combination of the impurities and air is provided with a radially outwardly directed momentum by the provision of the second cascade 100 of compressor blades 102. Because the mass of the entrained particulate matter is greater than that of the air, the radial outward momentum of the fine dust particles is greater than that of the air and thus additional fine dust particles are radially impelled into the main flow stream and through the shroud 70, as indicated by directional flow arrows 106, while the air may be drawn into passage 90.

In order to optimize the flow characteristics of the air through the two cascades of compression blades it will be noted that, not only is the blade profile varied, but the aspect ratio (height over chord, h/c) of the first cascade of blades is greater than the aspect ratio of the second cascade of blades.

Notwithstanding the third echelon of entrained matter removal some very fine particulate matter may remain suspended within the inlet air stream and passes through passage 90 toward the carburetor 92. In order to further cleanse the air a fourth echelon of particulate matter removal is provided by an accumulation chamber filtration system as illustrated in FIGS. 3 and 4.

More particularly an accumulation chamber 30 is positioned within the passage 90, between the passage inlet 103 and the carburetor 92. The accumulation chamber 30, defined by a cover 31, is provided with a filter diaphragm 112 which is constructed with a window 114 to permit air to enter the chamber from passage 90 in a position above the filter as indicated by flow arrows 110. Positioned beneath the filter diaphragm 112 is a second accumulation chamber 116 which opens into carburetor 92.

By the provision of the foregoing described structure air which is drawn through passage 90 is able to expand into the accumulation chamber 30, reverse the direction of flow thereof and seep through filter 112 into chamber 116 and ultimately the carburetor 92. This fourth echelon of particulate matter removal is capable of removing very fine dust particles that previously would have entered the carburetor and the combustion cycle.

Since coarse and fine dust and other entrained matter has been removed prior to the air entering accumulation chamber 30, filter 112 may be designed for very fine filtration without becoming rapidly clogged. In the event, however, that it is desirable to service the filter 112 after a substantial period of use, the cover 31 may be readily removed by removing a centrally positioned conventional mechanical fastener 118.

Process of Particulate Matter Removal.

Referring now particularly to FIG. 7, there will be seen in a schematic sequential array the steps of removing particulate matter that may be entrained within the intake air prior to delivery of the intake air into the carburetor of a chain saw internal combustion engine.

The initial particulate removal step (not illustrated) is provided by the coarse frustoconical screen 76 which filters out relatively large objects such as leaves, wood chips, etc. thus permitting air and the entrained finer particles to enter into the shroud 70 as depited by flow arrows 86. In this connection air is drawn into the shroud 70 by suction produced by the compressor blades 82 which are mounted upon hub 84.

The blades 82 are of the radial flow compression type such that air will be sucked axially toward the hub 84 and radially impelled outwardly from the hub axis toward the shroud 70. The air and entrained matter will leave the blades 82 at approximately the same velocity. However, because dirt and saw dust particles have a greater mass than that of air, such particles will have a greater radial momentum and will thus tend to flow in the direction of arrow 120 and impinge upon the inner surface of the shroud 70 as indicated at 122. In practice it has been found that the shroud 70 is continually cleansed by the high volume of flow passing through the shroud and such large dust particles are vented out from the shroud through the outlet 74 as previously mentioned.

Also as previously noted, when the engine is operating, a vacuum will be drawn through the carburetor and thus air will tend to be sucked around the edge of the hub 84 and toward the carburetor 92. Because the air has a lower mass than coarse entrained particles the air will more readily bend as indicated by arrow 124 toward the passage 90. The second cascade of radial compression blades 102, however, will act upon the air passing behind the hub to slow the air flow and in at least some instances potentially produce eddy currents represented by circular phantom lines 104.

Of the air in the zone between the flywheel and the inner shroud portion 89 the blades will impel both particulate matter and air with the same velocity radially outward. The saw dust and dust particles have a higher mass than air and thus will have a higher momentum. As a consequence dust will tend to be radially impelled as represented by arrows 126, while the air particles having a lower momentum will tend to reverse in flow as indicated by arrows 128 and flow into the passage 90 leading to the carburetor. It has been observed that not only will some of the fine dirt and saw dust particles be impelled into the main flow stream of the shroud, but some of the dust particles will also tend to collect upon the back surface of the leading edge of the vanes 102, as at 130.

The inlet air has now passed through three echelons of particulate matter removal and only very fine matter remains suspended within the air passing through passage 90. This air upon entering accumulation chamber 30 encounters a flow reversal indicated by arrows 110 and a decrease in velocity as previously discussed. The air seeps through filter 112 where very fine dust particles 132 are effectively removed. The thus cleansed air is then drawn into the carburetor 92 without producing the deleterious effects heretofore encountered in portable chain saw systems.

While the foregoing method and apparatus has been specifically described in relation to a chain saw it will be appreciated that other utility may be envisioned in connection with other internal combustion engines which work in a dust laden environment such as lawnmowers, concrete cutters, circular saws, generators, post hole diggers, earth tampers, concrete mixers, etc.

SUMMARY OF THE MAJOR ADVANTAGES

It will be appreciated that the above illustratively described invention provides a novel method and apparatus for removing paticulate material from the intake air of a chain saw internal combustion engine without using a conventional inlet filter. Further, the subject filtering system significantly provides sequential filtering stages, thus possessing the capability of filtering a wide size range of particulate matter from the inlet air while maintaining a sufficient volume of air flow so as not to disturb the optimum fuel to air ratio of the internal combustion engine cycle.

Further the novel method and apparatus of the subject invention provides a compact highly efficient synergistic relationship of elements which perform a multiplicity of functions to enable the equipment to be compact and easily portable.

In particular the subject invention advantageously utilizes two cascades of radial flow compressor blades, attached to a hub which also serves as a flywheel for the engine, to blow cooling air over the chain saw engine while simultaneously removing entrained impurities from the inlet air of the engine. Each cascade of blades is individually and uniquely formulated for maximum combinational performance.

The subject air treatment system further includes a coarse frustoconical inlet screen which is suitable to remove relatively large air entrained matter which would be capable of rapidly clogging fine air cleansing means. Still further the subject invention provides a unique accumulation chamber which combines air flow velocity reduction and flow reversal with a fine gauge diaphragm filter to remove very fine particulate matter which heretofore frequently had entered the carburetor and combustion cycle of chain saw engines.

Although the invention is described with reference to preferred embodiments, it will be appreciated by those skilled in the art that additions, deletions, modifications, substitutions and other changes not specifically described and illustrated in these embodiments, may be made which will fall within the purview of the appended claims.

What is claimed is:

1. A chain saw comprising:

a frame;

a guide bar, connected to said frame;

a cutting chain carried by said guide bar;

an internal combustion engine mounted upon said frame, including at least one piston and cylinder, a crankshaft connected to said at least one piston, and a carburetor operably connected to said at least one cylinder;

a shroud surrounding at least one end of said crankshaft and having an air inlet fashioned thereinto at a location adjacent to said one end of said crashshaft, and an air outlet fashioned thereinto at a location remote from said air inlet;

passage means leading to said carburetor and including a passage opening located adjacent to said one end of said crankshaft for providing fluid communication between said air inlet and said carburetor;

said carburetor being arranged to suck air inwardly through said passage opening during operation of said engine;

first means for removing air-entrained matter comprising a filter positioned across the inlet of said shroud for blocking entrance into said shroud of air-entrained debris;

second means for removing air-entrained matter and being drivingly connected to said one end of said crankshaft comprising a disc mounted upon said one end of said crankshaft such that said crankshaft defines an axis of rotation for said disc; and one side of said disc defining surface means around which the air from said air inlet must travel to reach said passage opening, said surface means having edge means located remotely from said axis of rotation and around which said air may travel;

a first cascade of vanes rearwardly swept with respect to the direction of rotation of the disc disposed upon said one side of said disc and extending between said air inlet and said disc;

said first cascade of vanes being oriented to promote a generally radially outwardly directed air flow to impel air and air-entrained matter from said air inlet through said first cascade of vanes in a direction generally radially away from said axis of rotation and impart sufficient momentum to at least some of said air-entrained matter to carry such matter past said passage opening and toward said air outlet;

third means for removing air-entrained matter and being connected to said one end of said crankshaft comprising a second cascade of vanes rearwardly swept with respect to the direction of rotation of the disc disposed upon the opposite side of said disc between said passage opening and said carburetor;

said second cascade of vanes being oriented to generate air flow patterns which oppose a generally radially inwardly directed air flow established by said carburetor suction in a manner causing air-entrained matter traveling toward said passage means to be directed away from said passage opening;

fourth means for removing air-entrained matter from air traveling through said passage means and being positioned between said passage opening and said carburetor comprising an accumulation chamber positioned within said passage means between said passage opening and said carburetor, said chamber including an entrance and exit communicating with said passage means.

a substantially flat filter diaphragm positioned across said accumulation chamber and including an aperture aligned with said entrance so that air entering into said accumulation chamber must reverse its flow before passing through said filter, and removable cap disposed adjacent said filer diaphragm to provide access to said filter diaphragm for cleaning or replacement.

* * * * *